United States Patent [19]

Weidner et al.

[11] Patent Number: 4,543,121

[45] Date of Patent: Sep. 24, 1985

[54] METHOD OF REDUCING HYDROCARBON EMISSIONS OCCURRING DURING IRON ORE SINTERING OPERATIONS

[75] Inventors: Ralph F. Weidner, Chagrin Falls; Carl W. Regutti, Shaker Heights; Chien W. Liao, Beachwood, all of Ohio

[73] Assignee: The Mogul Corporation, Chagrin Falls, Ohio

[21] Appl. No.: 588,780

[22] Filed: Mar. 12, 1984

[51] Int. Cl.[4] ..... C22B 1/16

[52] U.S. Cl. ..... 75/5; 75/3

[58] Field of Search ..... 75/3-5

[56] References Cited

U.S. PATENT DOCUMENTS 2,834,660 5/1958 Eisenhut ..... 75/3

4,274,863 6/1981 Metz ..... 75/5

*Primary Examiner*—Peter D. Rosenberg

*Attorney, Agent, or Firm*—Fay, Sharpe, Fagan Minnich & McKee

[57] ABSTRACT

A method is provided for reducing the hydrocarbon content of the gases produced during the agglomeration of fine iron-containing particles by sintering them in the presence of carbonaceous material which comprises contacting a mixture of fine iron-containing particles and carbonaceous materials with an effective amount of a hydrocarbon oxidation catalyst; and heating the mixture in an oxygen containing atmosphere to a temperature sufficient to cause the carbonaceous material to burn and the fine iron-containing particles to fuse and become bonded together to form an agglomerated mass of coarse iron-containing particles.

16 Claims, No Drawings

METHOD OF REDUCING HYDROCARBON EMISSIONS OCCURRING DURING IRON ORE SINTERING OPERATIONS

BACKGROUND OF THE INVENTION

The present invention relates to a means for reducing the amount of hydrocarbon vapors produced during iron ore sintering operations. More particularly, it concerns a means of reducing or substantially eliminating the amount of undesirable hydrocarbon vapors formed during sintering operations by treating the mass being sintered with an effective amount of an oxidation catalyst.

Today, in the iron and steel industry iron-containing materials having a fine particle size are converted into a coarse agglomerated material by heating such particles in the presence of combustible carbonaceous materials. This technique is generally referred to as a "sintering" process. The raw or starting materials include iron containing particles and a source of combustible carbon. Fluxing agents and fuel-bearing materials, as well as hydrocarbons (present as undesirable contaminants) are included among these raw materials. In practice, all the materials are intimately mixed together before being distributed or placed on a moving grate or stand. Once on the grate, the combustibles are ignited as air is drawn through the top of the moving mass. Such ignition causes the fine particles to fuse (sinter) and form an agglomerated mass.

While the foregoing sintering technique is widely utilized, associated therewith are certain undesirable environmental problems. For example, the evolution of unburned hydrocarbon vapors from the sintering process generally can not be permitted to escape into the atmosphere. To prevent this, it is often necessary to use very complicated and rather expensive equipment.

Accordingly, it is the principal object of the present invention to provide an effective, economical means for reducing undesirable hydrocarbon emissions produced during the sintering of fine iron-containing particles to produce an agglomerated mass of coarse iron-containing particles.

Other objects of the present invention will become apparent to those skilled in the art from a reading of the following specification and claims.

SUMMARY OF THE INVENTION

In one aspect, the present invention concerns a method of reducing the hydrocarbon content of gases produced during the agglomeration of fine iron-containing particles by sintering them in the presence of a carbonaceous material to produce a coarse iron-bearing mass which comprises providing a mixture of fine iron-containing particles and a combustible carbonaceous material; contacting the mixture with an effective amount of a hydrocarbon oxidation catalyst; and heating the mixture in an oxygen containing atmosphere to a temperature sufficient to cause the carbonaceous material to burn and the fine iron-containing particles to become sintered and bonded together to form an agglomerated mass of coarse iron-containing particles.

In still another aspect, the instant invention relates to an improvement in the method of agglomerating fine iron-containing particles by mixing them with a combustible carbonaceous material and heating the so-formed mixture in the presence of oxygen to a temperature sufficient to cause the carbonaceous material to burn and the fine iron-containing particles to become sintered and bonded together to form a mass of coarse iron-containing particles, wherein the improvement comprises contacting the mixture of fine iron-containing particles and carbonaceous material with an effective amount of a hydrocarbon oxidation catalyst prior to burning the carbonaceous material whereby the amount of unburned hydrocarbon vapor produced by the burning of said carbonaceous material is significantly reduced.

DETAILED DESCRIPTION OF THE PRACTICE OF THE INVENTION

The present invention concerns the addition of an effective amount of a hydrocarbon oxidation catalyst to a mixture of fine iron-containing particles and a combustible carbonaceous material prior to oxidizing (burning) the carbonaceous material to generate heat to cause the fine iron-containing particles to fuse together and form an agglomerated mass of coarse iron-containing particles.

The exact sintering process employed is not critical to the practice of the instant invention. All that is required is that both iron-containing particles and combustible carbonaceous material be present. Typically, such mixtures are achieved by mixing together such materials as limestone aggregates, coke breeze, lump ore, carbon-scrap, mill scale and iron ore itself.

In practice, it is desired that the oxidation catalyst be thoroughly mixed with both the iron-containing particles and the carbonaceous material before sintering. This can be accomplished in a number of ways. For example, the oxidation catalyst can be added to and thoroughly mixed in with the material which is to be sintered or it can be sprayed onto the strand proper (the moving sintering bed).

Oxidation catalysts which are suitable in the practice of the instant invention include compounds containing transitional metals in various forms. For example, they can be organic compounds, inorganic compounds or a mixture of such compounds. Physically, they can be liquids or solids.

Especially good results are realized when the oxidation catalyst is a compound which contains a metal selected from the group consisting of iron, manganese, cerium, copper, cobalt, chromium, nickel, vanadium, the rare earths and mixtures thereof. Typical compounds include manganese carboxylates, copper naphthenate, cobalt naphthenate, iron naphthenate, manganese octoate, iron octoate, copper octoate, etc.

In the practice of the instant invention, the exact amount of oxidation catalyst utilized is not critical. All that is required is that enough catalyst be employed to significantly reduce the amount of hydrocarbon vapors produced during the sintering process. Generally, this can be accomplished by utilizing from about 5 to about 200 ppm of catalytic compound in the sinter burden, with exceptional results being achieved when the amount of catalyst ranges from about 20 to about 100 ppm in the sinter burden.

The subject invention will now be described with reference to the following examples.

EXAMPLE 1

A mixture of BOF (basic oxygen furnace) slag, roll scale, pellet fines, Chilean ore, dolomite, dust and sludge was obtained. This mixture was then sintered.

The effect realized by the practice of the present invention was measured by two different techniques. Specifically, the hydrocarbon level of the flue gas and the loss on ignition (LOI) on the fly ash taken from the flue gas were determined. A Century Organic Vapor Analyzer was used in conjunction with a Rustrak continuous tape recorder to give the hydrocarbon level of the flue gas. The Rader Sampler was used to obtain the fly ash sample from the flue gas and subsequently an LOI was run with it. A baseline was established before the test period. Usually, one to two hours of baseline would precede each two to four hours of chemical treatment.

Two separate comparative tests were conducted. One was directed to sintering the hereinbefore described mixture without any oxidation catalyst (baseline); the other (practice of the instant invention) concerned sintering essentially the same mixture which had 3.6 gallons per hour of manganese carboxylates (17.3% Mn) introduced on the conveyor belt (carrying the sinter burden) just before entering the mixing drum. The throughput of the burden (sinter charge) in this and other examples are 100 tons per hour. However, it could vary as much as between 50 to 200 tons per hour, with 100 tons per hour being the average load.

The comparative results obtained were as follows:

Hydrocarbon level (ppm) in flue gas:

a. without treatment: 2850 b. with treatment : 1600

% LOI (fly ash):

a. without treatment: 12.5, 12.9 b. with treatment : 11.8

Based on the foregoing, it is noted that a 44% reduction in the production of undesirable hydrocarbon vapors was achieved via the practice of the present invention.

EXAMPLE II

The procedure of Example I was repeated except 3.1 gallons per hour of manganese carboxylates (17.3% Mn) were sprayed on the material being sintered.

The comparative results obtained were as follows:

Hydrocarbon level (ppm) in flue gas:

a. without treatment: 300 b. with treatment: 90

% LOI (fly ash):

a. without treatment: 11.9 b. with treatment: 11.6

Based on the foregoing, it is noted that a 70% reduction in the production of undesirable hydrocarbon vapors was achieved via the practice of the present invention.

EXAMPLE III

The procedure of Example I was repeated except 3.1 gallons per hour of an oil soluble iron salt (17.8% iron) were sprayed on the material being sintered:

The comparative results obtained were as follows:

Hydrocarbon level (ppm) in flue gas:

a. without treatment: 3500 b. with treatment: 1500

% LOI (fly ash):

a. without treatment: 14.0 b. with treatment: 12.8

Based on the foregoing, it is noted that 57% reduction in the production of undesirable hydrocarbon vapors was achieved via the practice of the present invention.

EXAMPLE IV

The procedure set forth in Example I was repeated, except 2.0 gallons per hour of manganese carboxylates (17.3% manganese) were thoroughly mixed with the material to be sintered prior to the sintering procedure.

The comparative results obtained were as follows:

Hydrocarbon level (ppm) in flue gas:

a. without treatment: 150 b. with treatment: 50

Based on the foregoing, it is noted that 67% reduction in the production of undesirable hydrocarbon vapors was achieved via the practice of the present invention.

EXAMPLE V

The procedure set forth in Example I was repeated, except 2.0 gallons per hour of manganese carboxylates (17.3% manganese) were thoroughly mixed with the material to be sintered prior to the sintering procedure.

The comparative results obtained were as follows:

Hydrocarbon level (ppm) in flue gas:

a. without treatment: 157 b. with treatment: 48

Based on the foregoing it is noted that 69% reduction in the production of undesirable hydrocarbon vapors was achieved via the practice of the present invention.

EXAMPLE VI

The procedure set forth in Example I was repeated, except 2.0 gallons per hour of manganese carboxylates (17.3% manganese) were thoroughly mixed with the material to be sintered prior to the sintering procedure.

The comparative results obtained were as follows:

Hydrocarbon level (ppm) in flue gas:

a. without treatment: 1000 b. with treatment: 265

Based on the foregoing, it is noted that 74% reduction in the production of undesirable hydrocarbon vapors was achieved via the practice of the present invention.

EXAMPLE VII

The procedure set forth in Example I was repeated, except 1.0 gallon per hour of manganese carboxylates (17.3% manganese) were thoroughly mixed with the material to be sintered prior to the sintering procedure.

The comparative results obtained were as follows:

Hydrocarbon level (ppm) in flue gas:

a. without treatment: 267 b. with treatment: 61

Based on the foregoing, it is noted that 77% reduction in the production of undesirable hydrocarbon vapors was achieved via the practice of the present invention.

While there have been described herein what are at present considered to be the preferred embodiments of this invention, it will be apparent to those skilled in the art that various changes and modifications may be made therein without departing from the invention, and it is, therefore, intended in the appended claims to cover all such changes and modifications as fall within the true spirit and scope of the invention.

What is claimed is:

1. A method of reducing the hydrocarbon content of vapors produced during the agglomeration of fine iron-containing particles by sintering them in the presence of a carbonaceous material to produce a coarse iron-containing mass which comprises:

providing a mixture of fine iron-containing particles and a combustible carbonaceous material;

contacting said mixture with an effective amount of a metal containing hydrocarbon oxidation catalyst; and heating said mixture in an oxygen containing atmosphere to a temperature sufficient to cause said carbonaceous material to burn and said fine iron-containing particles to become sintered and bonded together to form a mass of coarse iron-containing particles.

2. The method of claim 1 wherein said oxidation catalyst is applied to said mixture by spraying the surface thereof prior to heating said mixture to cause said fine iron-containing particles to be sintered and bonded together to form a mass of coarse iron-containing particles.

3. The method of claim 1 wherein said oxidation catalyst is mixed with said mixture prior to heating said mixture to cause said fine iron-containing particles to become sintered and bonded together to form a mass of coarse iron-containing particles.

4. The method of claim 1 wherein said oxidation catalyst is applied to said mixture while on the moving sinter bed.

5. The method of claim 1 wherein said catalyst is a compound containing a transitional metal.

6. The method of claim 4 wherein said metal is selected from the group consisting of iron, manganese, cerium, copper, cobalt, chromium, nickel, vanadium, the rare earths and mixtures thereof.

7. The method of claim 1 wherein said oxidation catalyst is manganese carboxylate.

8. The method of claim 4 wherein said oxidation catalyst is iron carboxylate.

9. In the method of agglomerating fine iron-containing particles to produce a mass of coarse iron-containing particles which comprises mixing fine iron-containing particles with a combustible carbonaceous material and heating the so-formed mixture in the presence of oxygen to a temperature sufficient to cause the carbonaceous material to burn and the fine iron-containing particles to become sintered and bonded together to form a mass of coarse iron-containing particles, the improvement which comprises: contacting the mixture of fine iron-containing particles and carbonaceous material with an effective amount of a metal containing hydrocarbon oxidation catalyst prior to burning the carbonaceous material whereby the amount of unburned hydrocarbon vapors produced by the burning of said carbonaceous material is significantly reduced.

10. The method of claim 9 wherein said hydrocarbon oxidation catalyst is applied to said mixture by spraying the surface thereof prior to heating said mixture to cause said fine iron-containing particles to be sintered and bonded together to form a mass of coarse iron-containing particles.

11. The method of claim 9 wherein said oxidation catalyst is mixed with said mixture prior to heating said mixture to cause said fine iron-containing particles to become sintered and bonded together to form a mass of coarse iron-containing particles.

12. The method of claim 9 wherein said oxidation catalyst is applied to said mixture while on the moving sinter bed.

13. The method of claim 9 wherein said catalyst is a compound containing a transitional metal.

14. The method of claim 13 wherein said metal is selected from the group consisting of iron, manganese, cerium, copper, cobalt, chromium, nickel, vanadium, the rare earths and mixtures thereof.

15. The method of claim 9 wherein said oxidation catalyst is manganese carboxylate.

16. The method of claim 9 wherein said oxidation catalyst is iron carboxylate.

* * * * *